US008568499B2

(12) United States Patent
Nagata

(10) Patent No.: US 8,568,499 B2
(45) Date of Patent: Oct. 29, 2013

(54) VITRIFIED GRINDING STONE

(75) Inventor: Akira Nagata, Kurume (JP)

(73) Assignees: Noritake Co., Limited, Nagoya (JP); Noritake Super Abrasive Co., Ltd., Kurume (JP)

( * ) Notice: Subject to any disclaimer, the term of this patent is extended or adjusted under 35 U.S.C. 154(b) by 200 days.

(21) Appl. No.: 13/056,828

(22) PCT Filed: Jul. 2, 2009

(86) PCT No.: PCT/JP2009/062156

§ 371 (c)(1),
(2), (4) Date: Jan. 31, 2011

(87) PCT Pub. No.: WO2010/013580

PCT Pub. Date: Feb. 4, 2010

(65) Prior Publication Data

US 2011/0135906 A1 Jun. 9, 2011

(30) Foreign Application Priority Data

Jul. 31, 2008 (JP) ..... 2008-198353

(51) Int. Cl.

| | |
|---|---|
| ***B24D 3/00*** | (2006.01) |
| ***B24D 11/00*** | (2006.01) |
| ***B24D 3/02*** | (2006.01) |
| ***C09K 3/14*** | (2006.01) |
| ***B24B 1/00*** | (2006.01) |
| ***C09C 1/68*** | (2006.01) |

(52) U.S. Cl.
USPC ..... 51/307; 51/293; 51/295; 51/309

(58) Field of Classification Search
USPC ..... 51/307, 293, 295, 309
See application file for complete search history.

(56) References Cited

U.S. PATENT DOCUMENTS

| | | | | |
|---|---|---|---|---|
| 4,750,915 | A * | 6/1988 | Tomita et al. | 51/298 |
| 2001/0004631 | A1* | 6/2001 | Enomoto et al. | 508/110 |
| 2006/0010780 | A1* | 1/2006 | Hall et al. | 51/293 |

FOREIGN PATENT DOCUMENTS

| | | |
|---|---|---|
| JP | A 63-093567 | 4/1988 |
| JP | A 4-300165 | 10/1992 |
| JP | A 2000-079566 | 3/2000 |
| JP | A 2000-084857 | 3/2000 |
| JP | A 2000-226568 | 8/2000 |
| JP | A 2000-246647 | 9/2000 |
| JP | A 2001-205566 | 7/2001 |
| JP | A 2002-205273 | 7/2002 |
| JP | A 2005-081535 | 3/2005 |

OTHER PUBLICATIONS

International Search Report issued in PCT/JP2009/062156, mailed Jul. 28, 2009. (with English-language translation).

* cited by examiner

*Primary Examiner* — James McDonough
(74) *Attorney, Agent, or Firm* — Oliff & Berridge, PLC

(57) ABSTRACT

A vitrified grinding stone includes: abrasive grains; an inorganic binder that binds the abrasive grains; and air-communicating pores that are formed between the abrasive grains and the inorganic binder, micro-capsules that each encapsulate a lubricant and each have a diameter that is smaller than that of the air-communicating pore, being fixed on an inner wall surface of each of the air-communicating pores by an adhesive.

21 Claims, 9 Drawing Sheets

VITRIFIED GRINDING STONE

TECHNICAL FIELD

The present invention relates to a vitrified grinding stone that includes abrasive grains, an inorganic binder binding the abrasive grains, and air-communicating pores formed between the abrasive grains and the inorganic binder.

BACKGROUND ART

A porous vitrified grinding stone is known that has abrasive grains such as CBN abrasive grains, diamond abrasive grains, or an ordinary abrasive grains bound therein using a vitreous inorganic binder. Such a vitrified grinding stone is formed as, for example, an arc-shaped grinding stone piece and a plurality of such pieces are used as a vitrified grinding wheel that is formed by fixing the pieces using an adhesive on the outer circumferential surface of a disc-shaped core such as a base metal piece made of a metal or a ceramic core made of an inorganic material such as a vitrified structure. Such a vitrified grinding wheel provides a high grinding ratio and high grinding efficiency, and is advantageously used when a work to be ground such as a metal part or a hardened-steel product is ground at a high speed. For example, types of vitrified super-abrasive-grain grinding stone described in Patent Documents 1 and 2 correspond to the above vitrified grinding stone.

PRIOR ART DOCUMENT

Patent Documents

Patent Document 1: Japanese Laid-Open Patent Publication No. 2000-084857
Patent Document 2: Japanese Laid-Open Patent Publication No. 2000-246647
Patent Document 3: Japanese Laid-Open Patent Publication No. 04-300165
Patent Document 4: Japanese Laid-Open Patent Publication No. 2005-081535

DISCLOSURE OF THE INVENTION

Problems to be Solved by the Invention

In the case of grinding a cam shaft or a crank shaft, for example, when the above vitrified grinding stone is used in grinding work that tends to generate grinding burns such as work of grinding a work to be ground that has a portion that is difficult to be supplied with a grinding liquid like a surface-contact portion such as a stepped face or an end face that crosses the rotation shaft center at a right angle, the grinding stone structure is made rough for the purpose of preventing the grinding burns, or the hardness of the grinding stone is reduced such that self-production of the proper abrasive-grain cutting edge can be obtained. However, in this case, a disadvantage arises that the lifetime of the grinding stone is shortened because the power to hold the abrasive grains is low.

Generally, the grinding burns are often generated especially immediately after dressing. This is because the bond is present on the same surface together with the abrasive grains on the surface of the grinding stone after the dressing. Therefore, after grinding a plurality of works, the bond on the surface of the grinding stone retreats more than the abrasive grains and, as a result, the original sharpness is gradually restored. Based on this fact, immediately after dressing, grinding work is executed with the grinding efficiency, that is, the speed of cutting set to be low or a setting process is executed in addition to the dressing. This causes the degradation of the productivity of the grinding work.

Furthermore, for example, in super-finishing polishing of the surface of a raceway track of a bearing, a processing agent such as sulfur or wax is impregnated in the grinding stone for the purpose of improving the surface roughness and preventing metal deposition. However, in such a case, the processing agent fills all of the air-communicating pores in the grinding stone and, therefore, the grinding liquid can not sufficiently flow into the grinding stone. Therefore, a disadvantage arises that degradation of grinding performance is caused.

As described in Patent Documents 3 and 4, a grinding stone is proposed that is formed by dispersing micro-capsules each encapsulating a grinding liquid (lubricant), etc., in its metallic deposit phase together with super abrasive grains. The micro-capsules are broken and form chip pockets only when the micro-capsules are exposed on the surface (grinding surface) of the dense metallic deposit phase and, thereby, the micro-capsules enable the chips to be discharged and incidentally supply the grinding liquid. Therefore, when a work to be ground is ground at high grinding efficiency using the vitrified super-abrasive-grain grinding stone, the grinding stone does not produce any function of supplying the grinding liquid also to the portion that is difficult to be externally supplied with the grinding liquid, occurring due to the shape of the work to be ground and, thereby, preventing the grinding burn of the portion.

The present invention was conceived in view of the above circumstances and the object thereof is to provide a vitrified grinding stone that generates no grinding burn of a work to be ground in grinding its portion that is difficult to be supplied with a grinding liquid between the work to be ground and the grinding stone and that does not degrade the quality of the grinding on the grinding surface.

As a result of various discussions with the above circumstances as the background, the inventor, etc., have found that, when air-communicating pores of a vitrified grinding stone after its burning are partially filled with micro-capsules each encapsulating a lubricant to lubricate the grinding grains and the micro-capsules are affixed thereto, grinding burns can advantageously be prevented in a portion that is difficult to be supplied with a grinding liquid like a surface-contact portion such as a stepped face or an end face that crosses the rotation shaft center of the work at a right angle and, therefore, stable grinding quality can be obtained for the grinding of the work to be ground. The present invention was conceived based on this knowledge.

Means for Solving the Problem

The object indicated above can be achieved according to a first aspect of the present invention, which provides a vitrified grinding stone includes: (a) abrasive grains; an inorganic binder that binds the abrasive grains; and air-communicating pores that are formed between the abrasive grains and the inorganic binder, (b) micro-capsules that each encapsulate a lubricant to lubricate the abrasive grains and each have a diameter that is smaller than that of the air-communicating pore, being fixed on an inner wall surface of each of the air-communicating pores by an adhesive.

Advantages of the Invention

According to the first aspect of the invention, the vitrified grinding stone, the micro-capsules that each encapsulate the lubricant to lubricate the abrasive grains and each have a diameter that is smaller than that of the air-communicating pore, are fixed on an inner wall surface of each of the air-communicating pores of the vitrified grinding stone by an adhesive. Therefore, the original functions of the air-communicating pores such as a function of supplying a grinding liquid and a chip-pocket function of removing chips from the grinding point are not lost and, therefore, a high grinding ratio and high-efficiency grinding can be obtained. Simultaneously, because the micro-capsules exposed on the grinding surface are broken and the grinding liquid encapsulated therein is released, grinding burns can be advantageously prevented in a portion that is difficult to be supplied with the grinding liquid like a surface-contact portion such as a stepped face of an end face that crosses at a right angle the rotation shaft center of the work to be ground. Therefore, stable grinding quality can be obtained.

Preferably, the abrasive grains are diamond abrasive grains or CBN abrasive grains that have the average grain diameter of five to 250 μmϕ; the air-communicating pores have the average inner diameter of five to 500 μmϕ; and the micro-capsules have the average capsule diameter of one to 200 μmϕ. Thereby, during the course of the manufacture of the vitrified grinding stone piece, the micro-capsules can be easily put in the air-communicating pores.

Preferably, the lubricant encapsulated in the micro-capsules includes a grinding liquid. Higher density in the grinding liquid causes lubricity, and, accordingly, preferably, the stock solution of the grinding liquid is used as the lubricant encapsulated in the micro-capsules. In this case, higher lubricating performance can be obtained and, therefore, grinding burns can advantageously be prevented.

Preferably, the outer skin of each of the micro-capsules is configured by any one of gelatin, a melamine resin, a phenolic resin, and a urea resin. Because the outer skin of each of the micro-capsules is configured by such an organic material, the micro-capsules can easily be broken and an advantage of giving no influence on the grinding performance can be obtained.

Preferably, the vitrified grinding stone is constituted of a grinding stone piece and a plurality of the grinding stone pieces are adhered to the outer circumferential face of the thick-plated and disc-shaped core of the super-abrasive-grain grinding wheel. This causes valid use of expensive grinding grains, and easily manufacturing of the super-abrasive-grain grinding wheel having a large diameter. The vitrified grinding stone may be a grinding stone that is made by integral forming.

BEST MODE FOR CARRYING OUT THE INVENTION

An embodiment of the present invention will be descried in detail with reference to the accompanying drawings. In the embodiment, the drawings are properly simplified or deformed and the dimension ratios, shapes, etc., of parts therein are not always correctly depicted.

Embodiment

Figure 1:
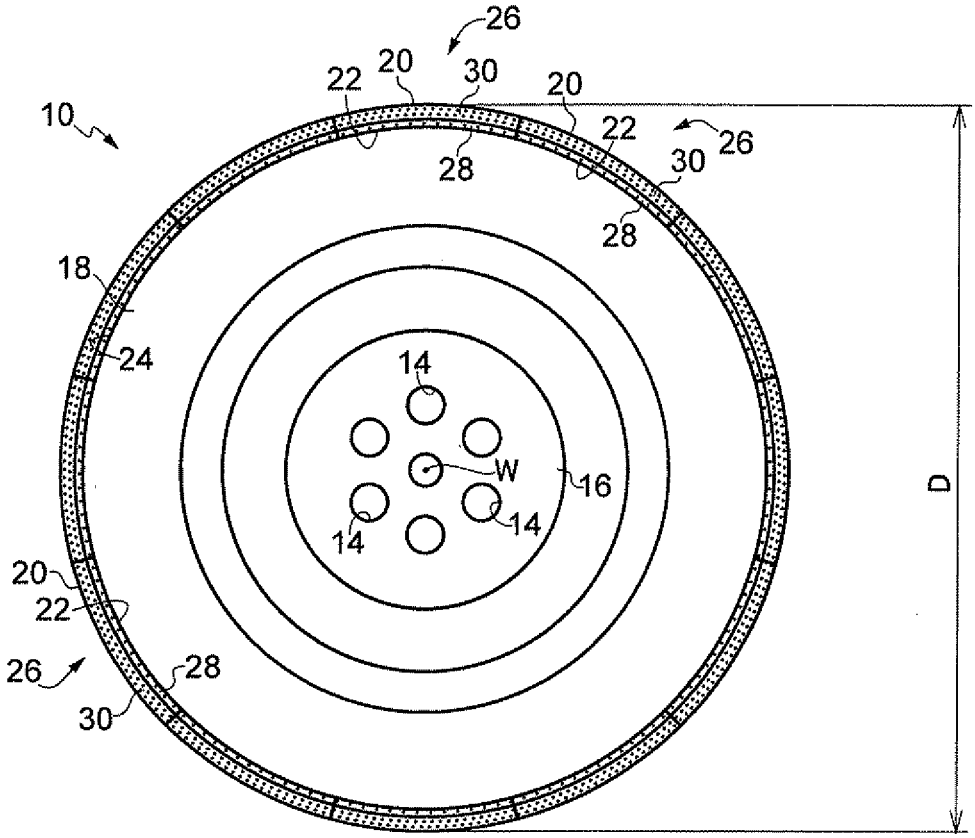
FIG. 1 is a front view of a vitrified super-abrasive-grain grinding wheel that is manufactured according to a manufacturing method of the embodiment of the present invention.

FIG. 1 is a front view of a vitrified super-abrasive-grain grinding wheel 10 that is manufactured according to a manufacturing method of the embodiment of the present invention. The vitrified super-abrasive-grain grinding wheel 10 includes: a base metal piece (core) 18 that is a disc-shaped piece made of a metal such as, for example, carbon steel or an aluminum alloy and that is provided with a mounting portion 16 having a mounting hole 14 in its central portion to mount the base metal piece 18 on a grinding apparatus (for example, a cylindrical grinding machine 12 described later); and a plurality of (in the embodiment, 12) vitrified grinding stone pieces 26 that each are an arc-shaped plate curved along an arc having the rotation shaft center W of the base metal piece 18 as its center of curvature, that each have a grinding surface 20 corresponding to its outer circumferential face and an adherence face 22 corresponding to its inner circumferential face opposite to the grinding surface 20, and whose adherence faces 22 adhere to the outer circumferential face 24 of the base metal piece 18 without any spacing. Though the size of the vitrified super-abrasive-grain grinding wheel 10 of the embodiment is properly set according to its use, the vitrified super-abrasive-grain grinding wheel 10 is configured, for example, to have dimensions of 380 mm ϕ as its outer diameter D and about 10 mm as its thickness without the mounting portion 16.

Figure 2:
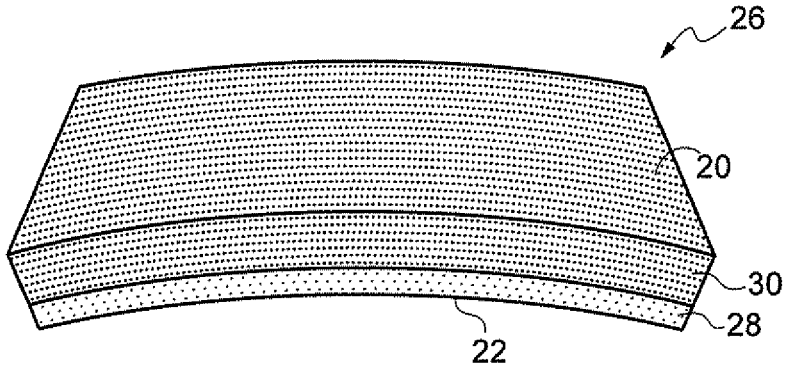
FIG. 2 is a perspective view of the vitrified grinding stone pieces of FIG. 1.

FIG. 2 is a perspective view of the vitrified grinding stone pieces 26. In FIGS. 1 and 2, the vitrified grinding stone piece 26 is integrally configured by: a base layer 28 found by binding ceramic ordinary abrasive grains such as fused-alumina, silicon-carbide, or mullite abrasive grains using a vitreous inorganic binder (a vitrified bond); and a grinding material layer 30 formed by binding super abrasive grains having the Knoop hardness of 3,000 or higher such as CBN abrasive grains or diamond abrasive grains using a vitreous inorganic binder. The base layer 28 dedicatedly functions as a base to mechanically support the grinding material layer 30. The grinding material layer 30 functions as a grinding stone to dedicatedly grind a work to be ground. For example, abrasive grains having the size within a range from 60 meshes [the average grain diameter of 250 μm] to 3,000 meshes [the average grain diameter of 5 μm] are advantageously used as the above super abrasive grains.

Figure 3:
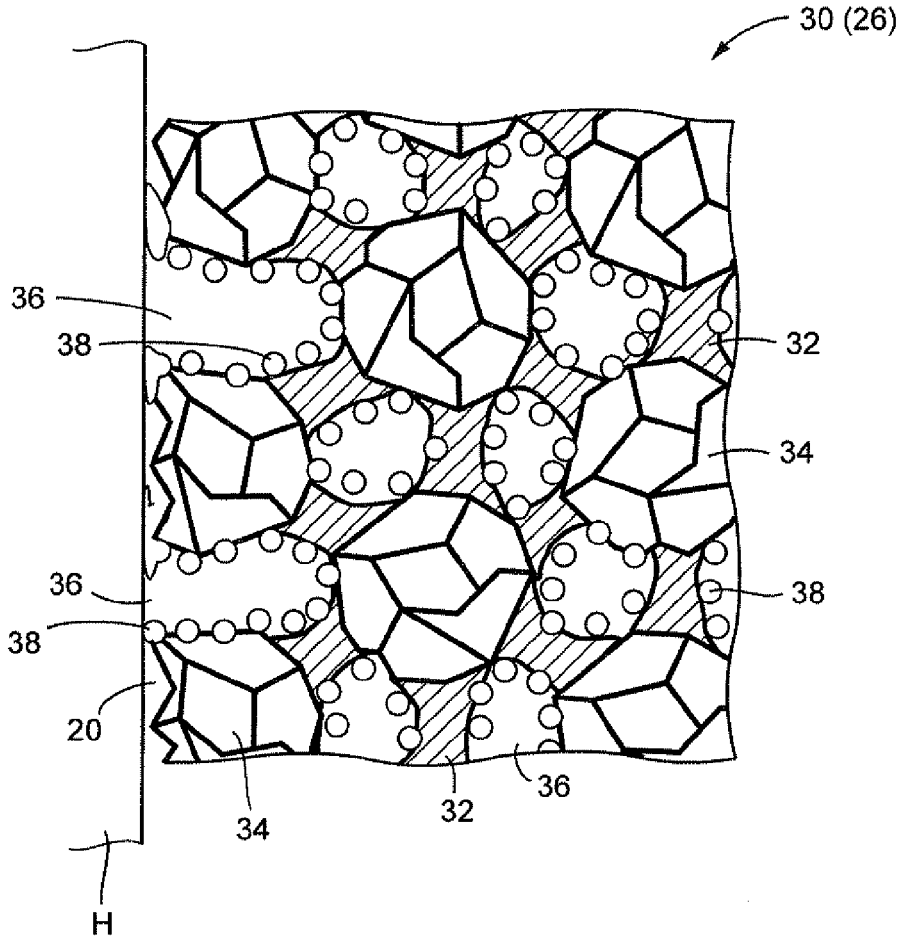
FIG. 3 is an enlarged schematic view showing the grinding stone structure of the vitrified grinding stone piece (the grinding material layer) of the vitrified super-abrasive-grain grinding wheel of FIG. 1.

FIG. 3 is a schematic view of an example a cross-sectional configuration of the grinding material layer 30 of the vitrified grinding stone piece 26, explaining the binding state of the vitrified bond 32 and the super abrasive grains 34 having the average grain diameter of, for example, five to 250 μmϕ, enlarging the binding state. In FIG. 3, air-communicating pores 36 having the average inner diameter of, for example, five to 500 μmϕ are formed between the vitrified bond 32 and the super abrasive grains 34. In each of the air-communicating pores 36, a plurality of micro-capsules 38 each having a grain diameter that is sufficiently smaller than that of the air-communicating pore 36 are fixed by an adhesive not depicted in the state where the air-communicating pore 36 is partially filled with the micro-capsules 38. The micro-capsules 38 have the average grain diameter of, for example, one to 200 μmϕ and are fixed in the air-communicating pore 36 such that, in the space of each of the air-communicating pores 36 having the inner diameter that is sufficiently larger than the average grain diameter of the micro-capsules 38, the micro-capsules 38 occupy a portion of the space at a volume factor to the extent that the original functions of the air-communicating pores 36 such as a function of supplying a grinding liquid and a chip-pocket function of removing chips from the grinding point are not lost with the volume factor. The micro-capsules 38 exposed on the grinding surface 20 that is the surface of the grinding material layer 30 are broken by a material to be ground 40.

Figure 4:
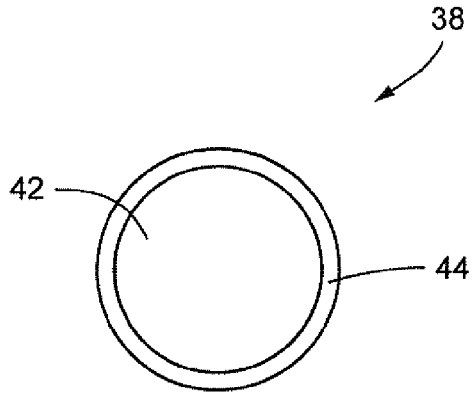
FIG. 4 illustrates the structure of the micro-capsules fixed in the state where the air-communicating pore formed in the abovementioned grinding stone structure is partially filled with the micro-capsules

For example, as depicted in FIG. 4, each of the micro-capsules 38 is configured by a lubricant 42 that is, for example, a stock solution of the grinding liquid and an outer skin 44 that encapsulates the lubricant 42. The outer skin 44 is configured by any one of organic materials such as gelatin, a melamine resin, a phenolic resin, and a urea resin such that, when the micro-capsules 38 are exposed on the grinding surface 20, their outer skins 44 are easily broken and do not influence on the grinding performance. The lubricant 42 may be a solution that is able to chemical-etch such as an acid solution when necessary.

Figure 5:
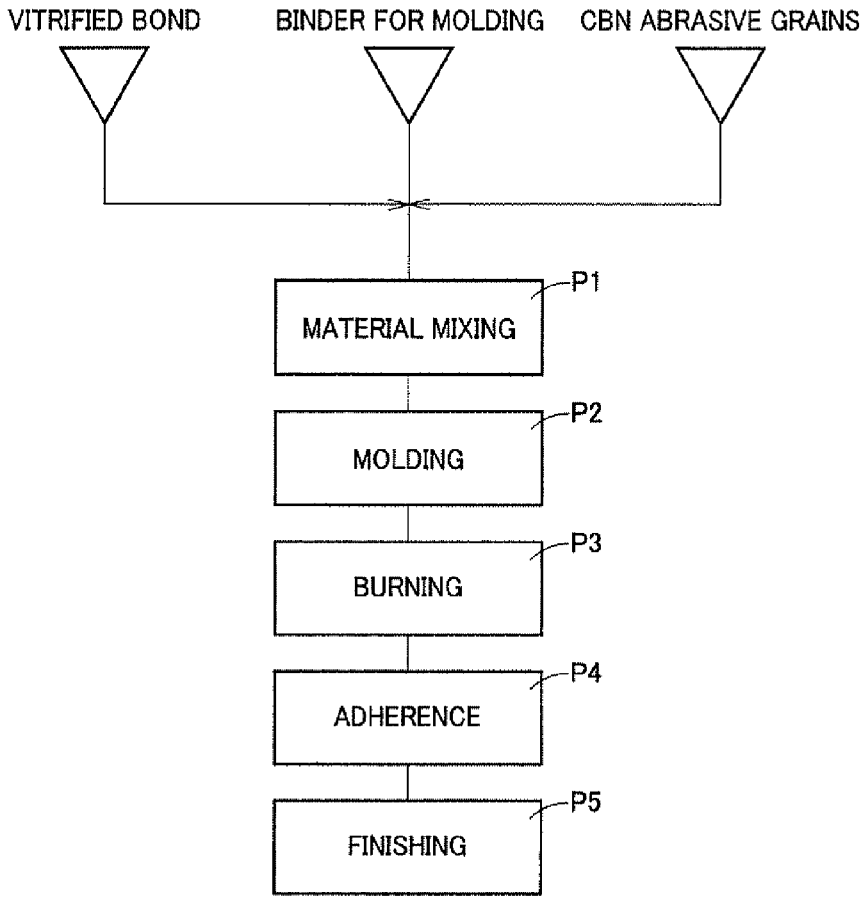
FIG. 5 is a process chart for explaining the gist of a manufacturing method of the vitrified super-abrasive-grain grinding wheel of FIG. 1.

FIGS. 5 to 8 are process charts for explaining the gist of a manufacturing method of the vitrified super-abrasive-grain grinding wheel 10. In FIG. 5, firstly, in a raw material mixing process P1, the abrasive grains, the vitreous inorganic binder (vitrified bond), a viscous binder (a paste content) such as dextrin to cause a mutual viscous binding force of some degree to be generated during molding, and an air-pore forming agent such as an organic or inorganic balloons that are properly mixed when necessary, that are the raw materials of the vitrified grinding stone piece 26 are weighted at rates set in advance for each of the grinding material layer 30 and the base layer 28 and are mixed. The base layer 28 does not need to always be formed and the air-pore forming agent does not need to always be used. In the embodiment, the raw materials are used, for example, at their rates listed in the following Table 1 for the grinding material layer 30 and at their rates listed in the following Table 2 for the base layer 28. When large air pores or huge air pores are actively formed, resin beads such as those of expanded polystyrene are used in addition to the above raw materials.

TABLE 1

| Name of Raw Material | Rate |
|---|---|
| CBN Abrasive Grains (#80/100) | 50 parts by volume |
| Vitrified Bond | 20 parts by volume |
| Paste Content | 6 parts by volume |

TABLE 2

| Name of Raw Material | Rate |
|---|---|
| Spherical Mullite | 35 parts by volume |
| Electro-Dissolved Mullite | 14 parts by volume |
| Vitrified Bond | 20 parts by volume |
| Paste Content | 6 parts by volume |

In a molding process P2, a molding cavity of a predetermined mold is sequentially filled with the mixed raw materials for the grinding material layer 30 and the mixed raw materials for the base layer 28 and, by pressurizing the materials, a molded piece having the shape depicted in FIG. 2 is molded. In a burning process P3, the molded piece is burned, for example, at a temperature of 1,000° C. or lower and for five hours and, thereby, the vitrified grinding stone piece 26 is manufactured that has, for example, the length of 40 mm, the width of 10.4 mm, and the thickness of 7.4 mm. By the burning, the organic materials such as the viscous binder included in the raw materials are caused to vanish and the inorganic binder is caused to melt. Thereafter, the abrasive grains are mutually bound by the inorganic binder that is solidified. Thereby, the vitrified grinding stone piece 26 manufactured has formed therein a porous vitrified grinding stone structure that has the super abrasive grains bound therein by the inorganic binder and that has many continuous air pores. The vitrified grinding stone piece 26 (grinding material layer 30) is a piece formed by binding the CBN abrasive grains of, for example, #80 at the degree of bond of "M" and the concentration ratio of 200 using the vitrified bond (CB80M200VN1).

In an adherence process P4, the vitrified grinding stone pieces 26 are fixed on the outer circumferential face 24 of the base metal piece 18 produced in advance without any spacing using, for example, an epoxy resin adhesive. In a finishing process P5, the surface of the base metal piece 18 fixed with the vitrified grinding stone pieces 26, that is, the vitrified super-abrasive-grain grinding wheel 10 is ground by a predetermined depth of, for example, about 0.5 to one mm using a dressing tool or a cutting tool and, thereby, the outer diameter dimension D, the roundness of the outer diameter dimension D, the thickness dimension, etc., of the vitrified super-abrasive-grain grinding wheel 10 are adjusted. By undergoing the processes P1 to P5, the vitrified super-abrasive-grain grinding wheel 10 is manufactured that is formed by fixing the vitrified grinding stone pieces 26 each having the super abrasive grains bound therein by the inorganic binder, on the outer circumferential face 24 of the base metal piece 18 as depicted in FIG. 1.

Figure 6:
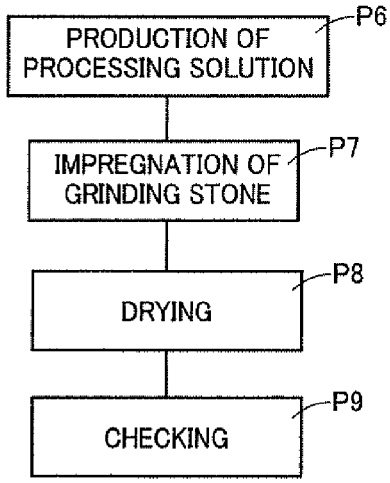
FIG. 6 is a process chart for explaining a process in which the portion of the space in each of the air-communicating pores of the vitrified grinding stone piece (the grinding material layer) of the vitrified super-abrasive-grain grinding wheel of FIG. 5 is filled with the micro-capsules at a predetermined filling factor and the micro-capsules are fixed.

In the embodiment, after the burning process P3, that is, before or after the adherence process P4 and the finishing process P5, the portion of the space in each of the air-communicating pores 36 of the vitrified grinding stone pieces 26 is filled with the micro-capsules 38 at a predetermined filling factor and the micro-capsules 38 are fixed in, for example, a process depicted in FIG. 6.

Figure 7:
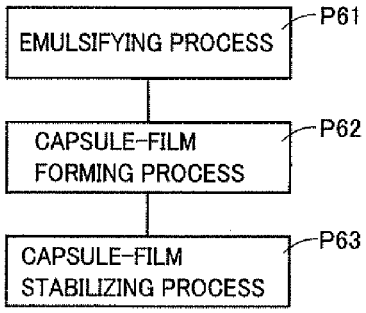
FIG. 7 is a process chart for explaining a process of FIG. 6 in which the processing solution is produced

In FIG. 6, in a processing solution producing process P6, the micro-capsules 38 manufactured in micro-capsule manufacturing processes P61 to P63 depicted in FIG. 7, a resin adhesive configured by a resole resin such as a liquefied phenol resin, a liquefied epoxy resin, or a liquefied melamine resin having the solid concentration of 48 percents by weight, and dilution water are mixed. Thereby, a processing solution is produced that has a large number of micro-capsules 38 dispersed therein. The processing solution is produced according to, for example, the rates listed in Table 3 when the outer skins 44 of the micro-capsules 38 are configured by gelatin films and the rates listed in Table 4 when the outer skins 44 of the micro-capsules 38 are configured by the melamine resin. The rate of water in the processing solution determines the volume factor (filling factor) of the micro-capsules 38 to the volume in the air-communicating pore 36. For example, the volume factor of the micro-capsules 38 to the volume in the air-communicating pore 36 is about 10% when the processing solution listed in Table 3 is used, and the volume factor of the micro-capsules 38 to the volume in the air-communicating pore 36 is about 22% when the processing solution listed in Table 4 is used.

TABLE 3

| Name of Raw Material | Rate |
|---|---|
| Micro-Capsule (Gelatin) | 10.5 percents by volume |
| Resin Adhesive | 5.4 percents by volume |
| Water | 84.1 percents by volume |

TABLE 4

| Name of Raw Material | Rate |
|---|---|
| Micro-Capsule (Melamine Resin) | 22.6 percents by volume |
| Resin Adhesive | 5.4 percents by volume |
| Water | 72.0 percents by volume |

Figure 8:
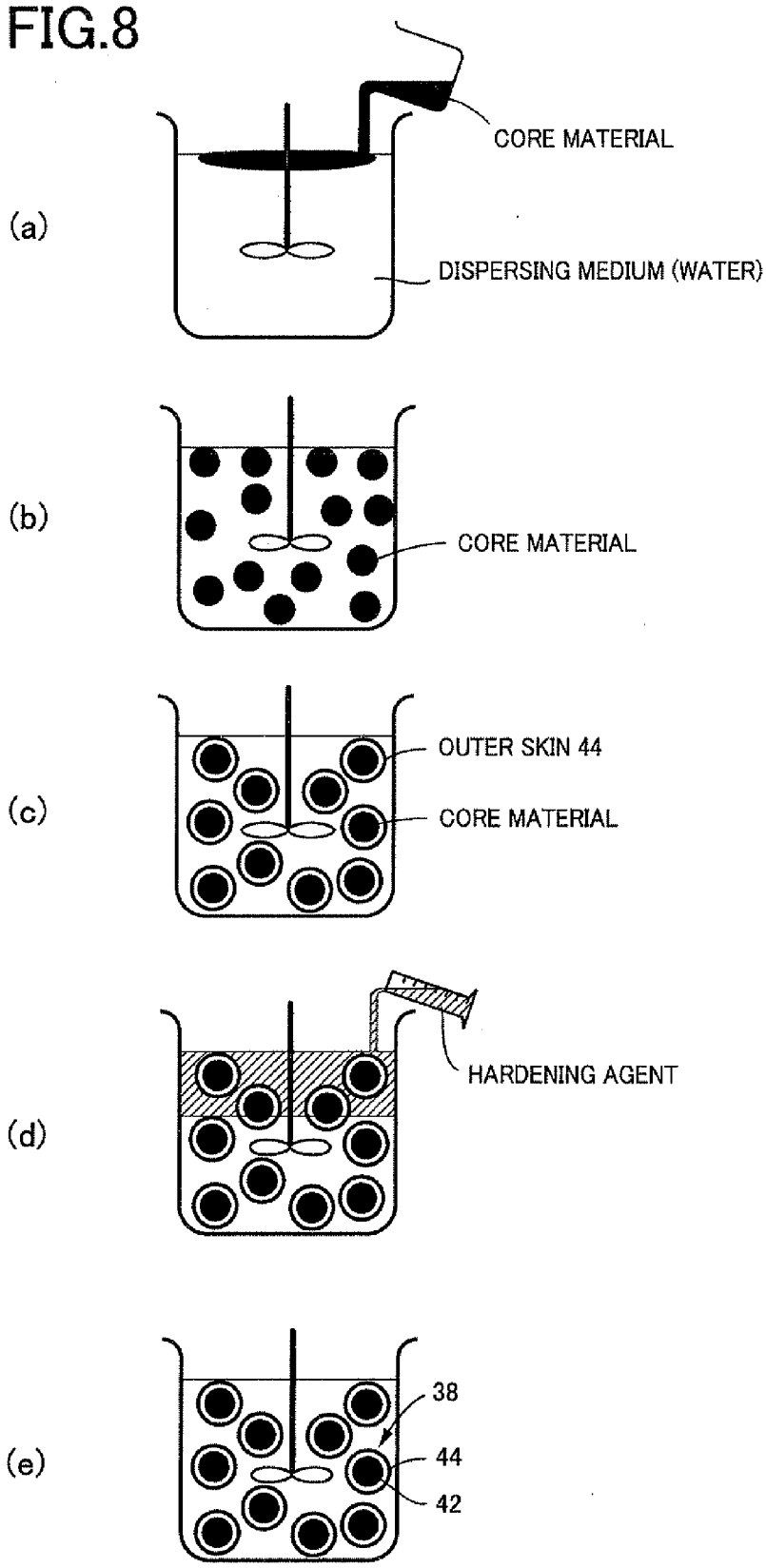
FIG. 8 is a process chart for explaining mixing steps to mix materials in the processing solution producing process of FIG. 7, (a) shows a process in which a core material is added into a dispersing medium, (b) shows a process in which the core material is agitated, (c) shows a process in which the outer skin of the micro-capsule is formed, (d) shows a process in which a hardening agent to harden the outer skin of the micro-capsule is added, and (e) shows a process in which the outer skin is stabilized by agitating after the hardening agent is added, respectively.

Of the micro-capsule manufacturing processes P61 to P63 depicted in FIG. 7, in the emulsifying process P61, a core material configured by a water-immiscible grinding liquid (a stock solution of an oil-based grinding liquid) and/or solid lubricant particles such as those of molybdenum disulfide is added to a dispersing medium configured by, for example, water and is agitated therein. Thereby, an emulsified liquid is produced. (a) and (b) of FIG. 8 depict this state. In the capsule film forming process P62, liquefied gelatin or a liquefied melamine resin is added to the emulsified liquid and the liquid is agitated. Thereby, the outer skin 44 configured by the gelatin or the melamine resin is formed around each piece of the core material. (c) of FIG. 8 depicts this state. In the capsule film stabilizing process P63, the liquid is further added with a hardening agent and is agitated. Thereby, the micro-capsules 38 are obtained dispersed in the liquid, that have, for example, the average capsule diameter of about 10 to 20 μmϕ, the thickness of about 10% of this diameter, and the outer skins 44 configured by the gelatin or the melamine resin after its hardening. (d) and (e) of FIG. 8 depict this state. Comparing the micro-capsules 38 each having the outer skin 44 configured by the gelatin with the micro-capsules 38 each having the outer skin 44 configured by the melamine resin, the latter has the capsule diameter of about 20 μmϕ and has more even capsule diameters than that of the former.

Referring back to FIG. 6, in a grinding stone impregnating process P7, the vitrified grinding stone piece 26 is dipped for about one minute in the processing solution produced in the processing solution producing process P6. Thereby, the air-communicating pores 36 of the vitrified grinding stone piece 26 are impregnated with the processing solution. This impregnation may be executed at the atmospheric pressure or may be vacuum impregnation executed in a vacuum. In a drying process P8, the vitrified grinding stone piece 26 impregnated with the processing solution is dried at the room temperature for 24 hours or is dried for several hours being heated. Thereby, the water in the processing solution is removed. Thereby, the micro-capsules 38 locally fill each of the air-communicating pores 36 of the vitrified grinding stone piece 26, and are fixed on the inner wall surface of each of the air-communicating pores 36. In a checking process P9, the state of the impregnation is checked.

Figure 9:
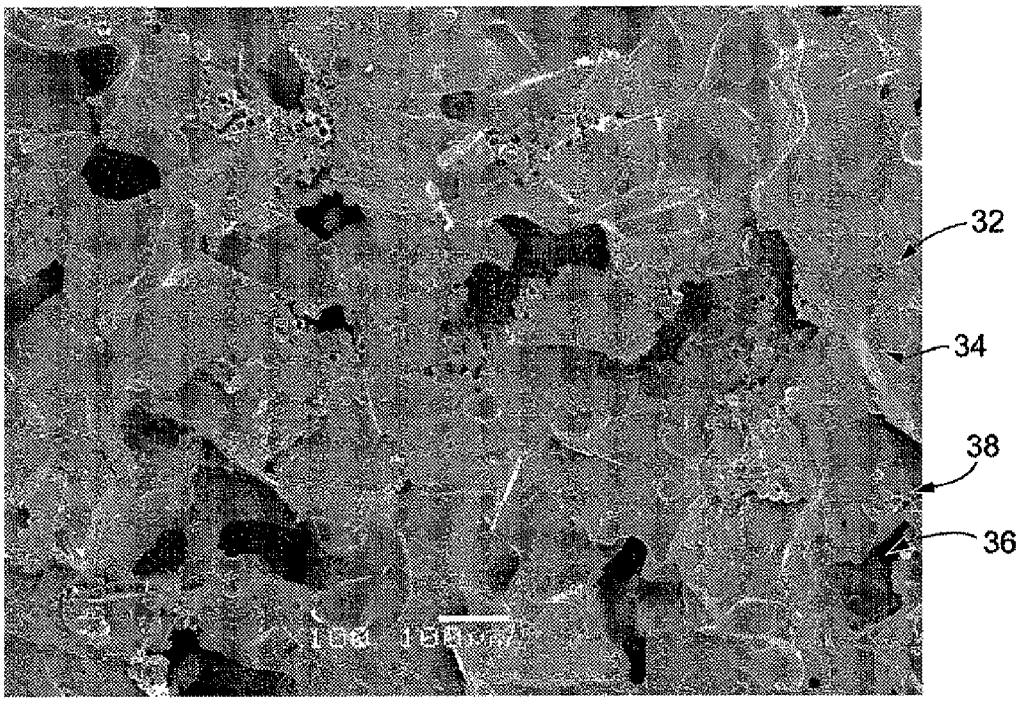
FIG. 9 is a 100-power electron microscope photograph of the grinding stone structure of the vitrified grinding stone piece (the grinding material layer) of the vitrified super-abrasive-grain grinding wheel after the air-communicating pore is filled with the micro-capsules
Figure 10:
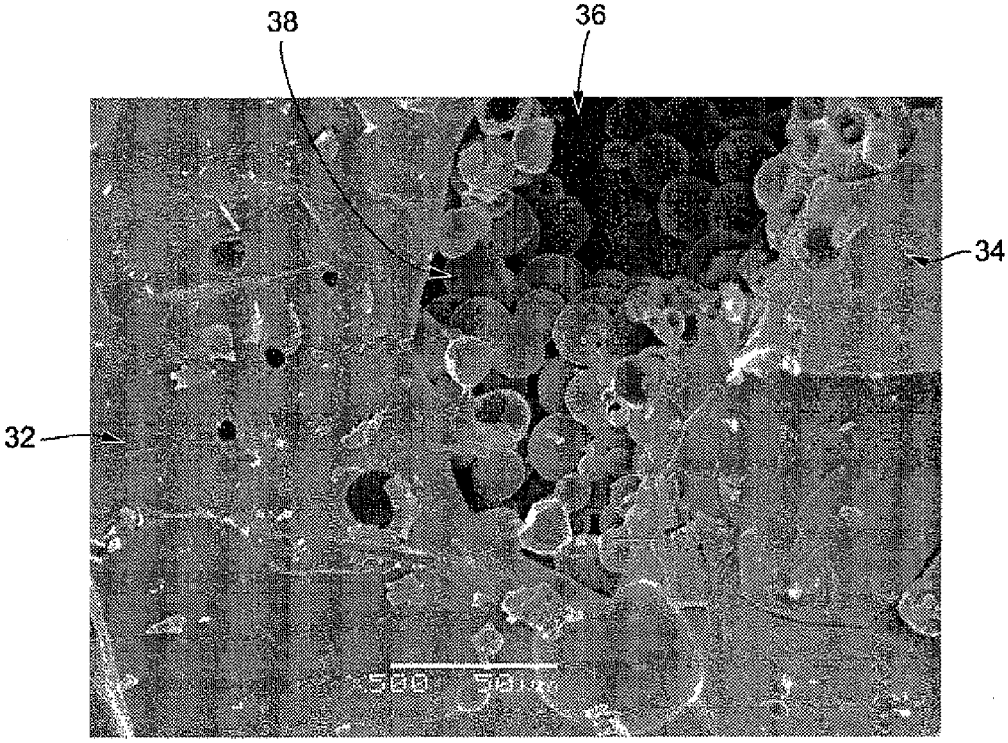
FIG. 10 is a 500-power electron microscope photograph of the grinding stone structure of the vitrified grinding stone piece (the grinding material layer) of the vitrified super-abrasive-grain grinding wheel after the air-communicating pore is filled with the micro-capsules.

FIGS. 9 and 10 depict cross sections of the vitrified grinding stone piece 26 manufactured in the processes of FIG. 6. FIG. 9 is a 100-power electron microscope photograph. FIG. 10 is a 500-power electron microscope photograph. As depicted in FIGS. 9 and 10, in each of the air-communicating pores 36 formed between the abrasive grains 34 bound by the vitrified bond 32, the spherical micro-capsules 38 are fixed filling the pore 36 at a predetermined filling factor.

Test Example 1

Figure 11:
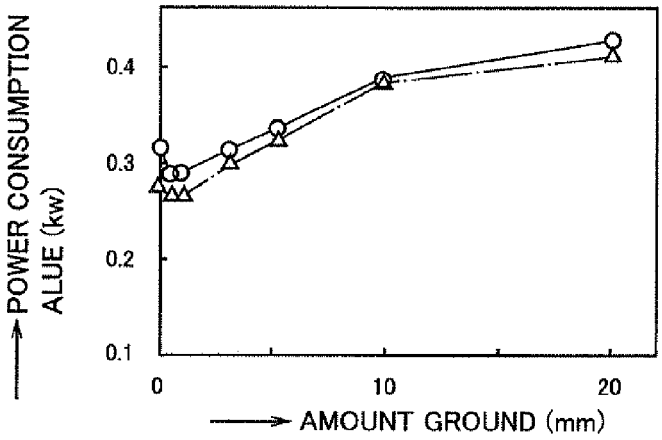
FIG. 11 is a graph showing the power consumption value in the grinding test 1 using the vitrified super-abrasive-grain grinding wheel of which the air-communicating pore is not filled with the micro-capsules and the vitrified super-abrasive-grain grinding wheel of which the air-communicating pore is filled with the micro-capsules.
Figure 12:
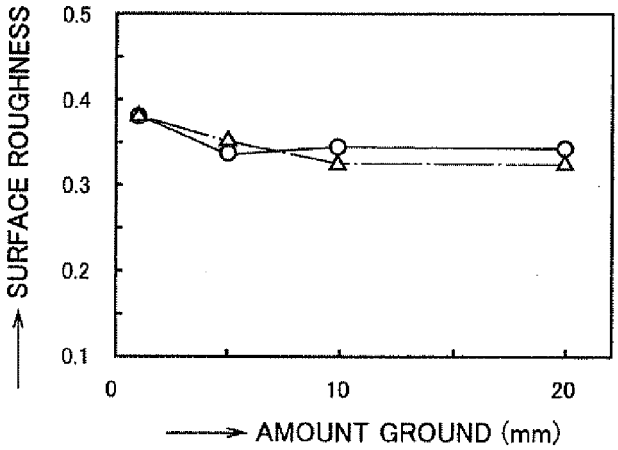
FIG. 12 is a graph showing the surface roughness in the grinding test 1 using the vitrified super-abrasive-grain grinding wheel of which the air-communicating pore is not filled with the micro-capsules and the vitrified super-abrasive-grain grinding wheel of which the air-communicating pore is filled with the micro-capsules.
Figure 13:
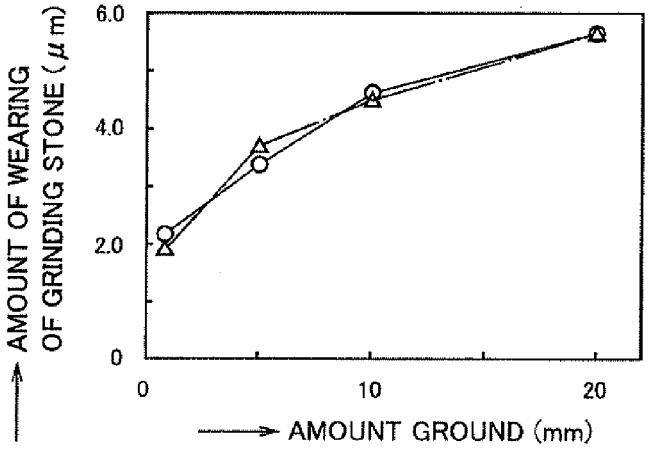
FIG. 13 is a graph showing the amount of the wearing of the grinding stone in the grinding test 1 using the vitrified super-abrasive-grain grinding wheel of which the air-communicating pore is not filled with the micro-capsules and the vitrified super-abrasive-grain grinding wheel of which the air-communicating pore is filled with the micro-capsules.

FIGS. 11 to 13 depict the results of surface grinding tests that evaluated the power consumption, the grinding burns, the wearing of the grinding stone, and the surface roughness in experiments executed by the inventor under the testing conditions listed in Table 5 using test samples 1 and 2 described as below. In FIGS. 11 to 13, "o" indicates the result of grinding executed using a test grinding stone 1 (a grinding stone that is not micro-capsule-processed) and "Δ" indicates the result of grinding executed using a test grinding stone 2 (a grinding stone that is micro-capsule-processed). According to the results of surface grinding tests depicted in FIGS. 11 to 13, compared to the test grinding stone 1 that is an unprocessed grinding stone, the test grinding stone 2, which is micro-capsule-processed, needed lower initial power (FIG. 11), provided the surface roughness that was improved to some extent (FIG. 12), and suffered the same level of grinding stone wear (FIG. 13).

Test Grinding Stone 1: CB80M200V (A vitrified grinding stone piece manufactured in the processes depicted in FIG. 6: the unprocessed grinding stone whose air-communicating pores are not filled with the micro-capsules)

Test Grinding Stone 2: CB80M200V (A vitrified grinding stone piece manufactured in the processes depicted in FIGS. 6 and 7: a micro-capsule-processed grinding stone that has the micro-capsules each encapsulating the water-immiscible grinding liquid and each having the outer skin made of the melamine film, adhering to and partially filling each of the air-communicating pores of the grinding stone)

[Table 5] Conditions for Surface Grinding Test

Grinding Machine Hitachi surface grinding machine GHLB306-4

Dimensions of Grinding Stone: 205 mmϕ×13 mmT×76.2 mmH

Work to Be Ground: SKD11 (100 mm×10 mm×T)

Depth of Grinding: 5 μm on one side/one pass

Table Traversing Speed: 20 m/min

Grinding Liquid: NORITAKECOOL SEC-700 (from NORITAK CO. LIMITED)

Dresser: 50-mmϕ Sharper [2 μm/grinding]

Test Example 2

Figure 14:
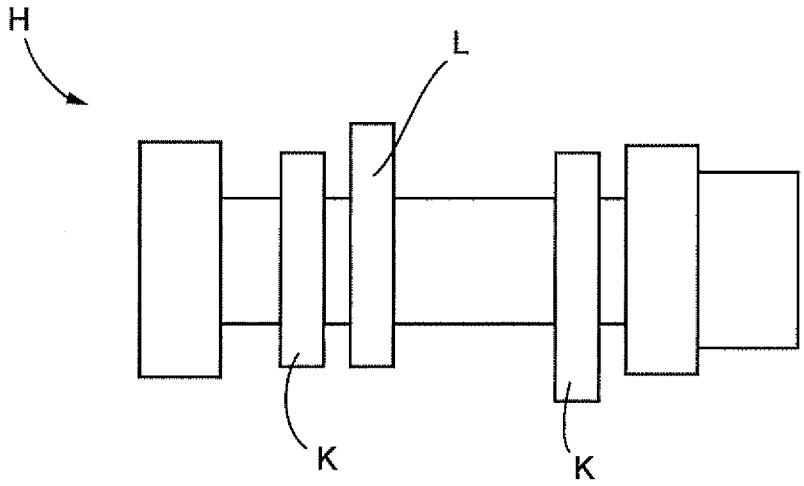
FIG. 14 shows the shape of the work used in the grinding test 2 to grind a cam shaft, using the vitrified super-abrasive-grain grinding wheel of which the air-communicating pore is not filled with the micro-capsules and the vitrified super-abrasive-grain grinding wheel of which the air-communicating pore is filled with the micro-capsules.
Figure 15:
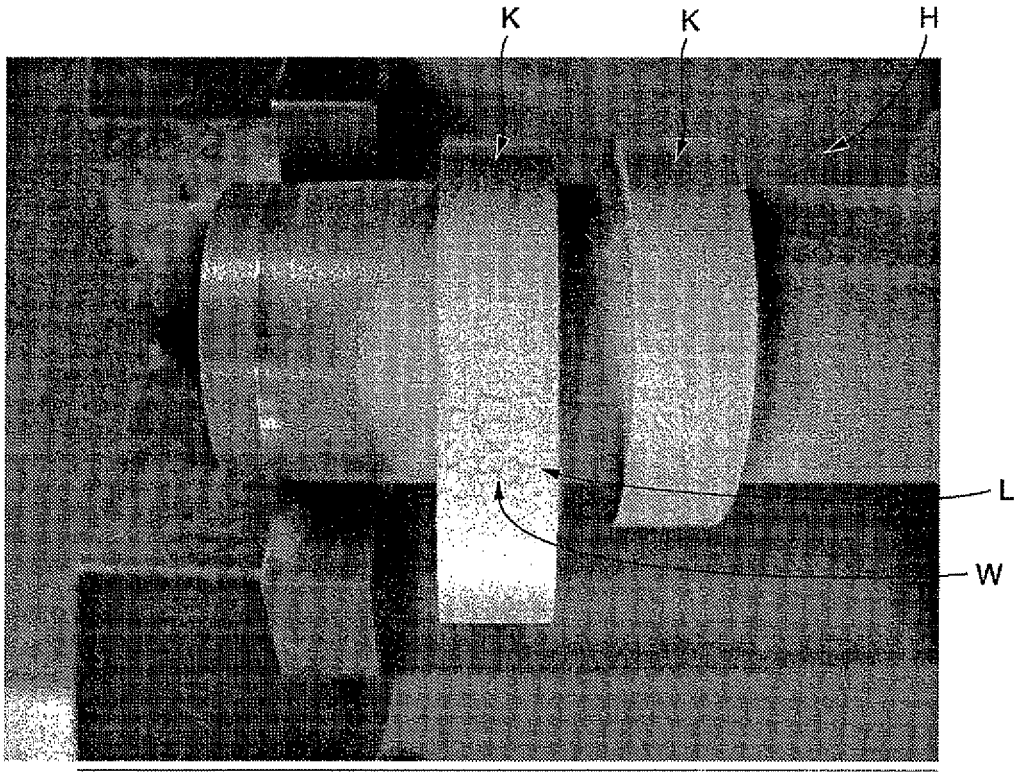
FIG. 15 is a photograph showing no occurrence of cracks on the ground work of FIG. 14 due to the grinding burn, using the vitrified super-abrasive-grain grinding wheel of which the air-communicating pore is filled with the micro-capsules.
Figure 16:
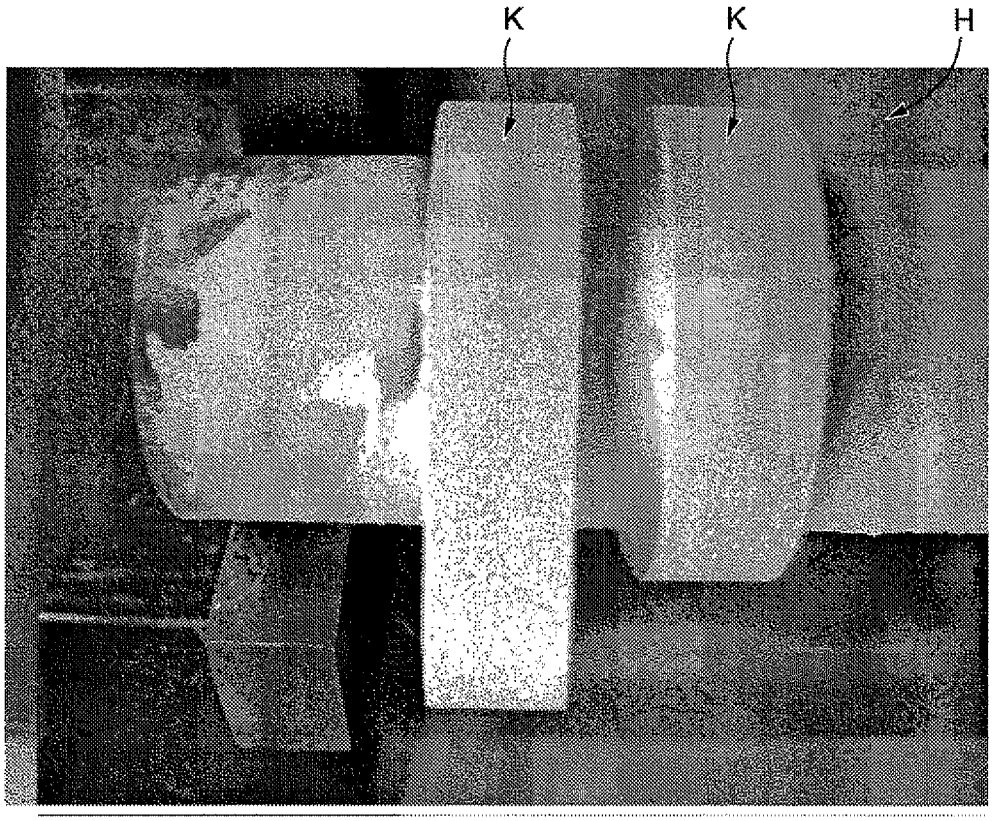
FIG. 16 is a photograph showing the occurrence of cracks on the ground work of FIG. 14 due to the grinding burn, using the vitrified super-abrasive-grain grinding wheel of which the air-communicating pore is not filled with the micro-capsules.

A cam shaft is a shaft depicted in FIG. 14 that integrally has a rice-ball-shaped cam K. The outer circumference against this cam is ground (polished) using each of the test grinding stones 1 and 2, and grinding burns of a work to be ground (the cam shaft) H are evaluated using a color checking liquid (color-developing liquid-penetrant inspection agent). This color checking liquid is configured by three liquids of a penetrant, a remover, and a developer that are sequentially applied, and causes cracks, flaws, pin-balls, etc., on the metal surface to appear in red. FIG. 15 depicts the result of the color checking obtained when the cam portion was ground using the unprocessed test grinding stone 1. An apparent grinding burn crack W was observed on the outer circumferential surface of a lifted portion L. The grinding surface load was large on the lifted portion L that had a large curvature radius in the outer circumferential surface of the cam K and, therefore, a burn crack tended to be generated in the lifted portion L. FIG. 16 depicts the result of the color checking obtained when the outer circumferential surface of the cam K was ground using the test grinding stone 2 that had been micro-capsule processed. No generation of any grinding burn crack was observed at all on the outer circumferential surface of a lifted portion S.

Test Example 3

Figure 17:
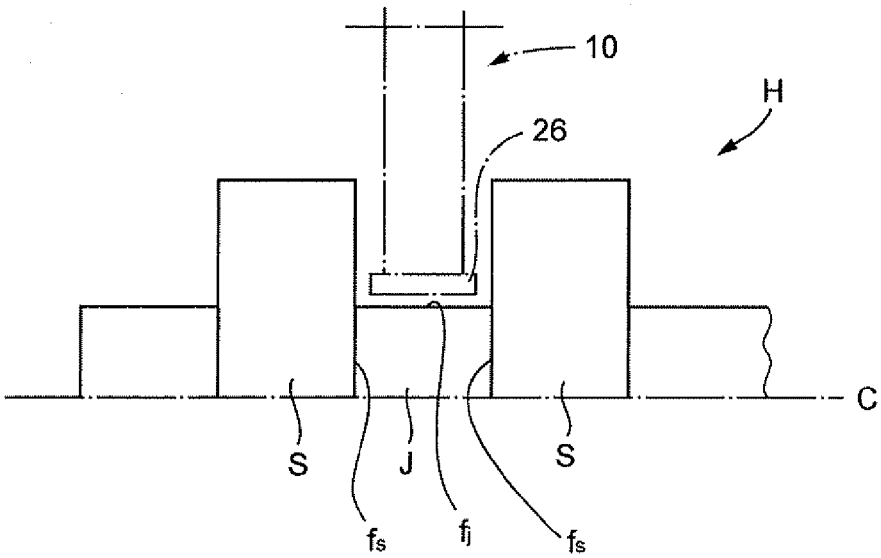
FIG. 17 shows the shape of the work used in the grinding test 3 to grind a crank shaft, using the vitrified super-abrasive-grain grinding wheel of which the air-communicating pore is not filled with the micro-capsules and the vitrified super-abrasive-grain grinding wheel of which the air-communicating pore is filled with the micro-capsules.

FIG. 17 depicts the shape of a work to be ground H having a shape that is similar to that of the crank shaft used by the inventor in the grinding test. The work to be ground H includes a columnar journal portion J to be supported by a bearing and a pair of shoulder portions S sandwiching the journal portion J in the direction of the shaft center C. The outer circumferential surface of the journal portion J and an end face each of the pair of shoulder portions S were ground (polished) using the test grinding stones 1 and 2. When the test grinding stone 1 was used, a burn was generated on the end face of each of the shoulder portions S. However, when the test grinding stone 2 was used, no burn was observed on the end face of each of the shoulder portions S.

As above, according to the vitrified grinding stone piece 26 of the vitrified super-abrasive-gain grinding wheel 10 of the embodiment, the micro-capsules 38 that each encapsulate the lubricant 42 to lubricate the grinding point of the abrasive grains 34, that is, the cutting edge are fixed in each of the air-communicating pores 36 of the vitrified grinding stone piece 26 partially filling the air-communicating pore 36. Therefore, the original functions of the air-communicating pores such as a function of supplying a grinding liquid and a chip-pocket function of removing chips from the grinding point are not lost and, therefore, a high grinding ratio and high-efficiency grinding can be obtained. Simultaneously, because the micro-capsules 38 exposed on the grinding surface 20 are broken and the grinding liquid 42 encapsulated therein is released, grinding burns can be advantageously prevented in a portion that is difficult to be supplied with the grinding liquid like a surface-contact portion such as a stepped face or an end face that crosses at a right angle the rotation shaft center of the work to be ground H. Therefore, stable grinding quality can be obtained.

In the vitrified grinding stone piece 26 (the grinding material layer 30) of the embodiment: the abrasive grains 34 are diamond abrasive grains or CBN abrasive grains that have the average grain diameter of five to 250 μmϕ; the air-communicating pores 36 have the average inner diameter of five to 500 μmϕ; and the micro-capsules 38 have the average capsule diameter of one to 200 μmϕ. Thereby, during the course of the manufacture of the vitrified grinding stone piece 26, the micro-capsules 38 can be easily put in the air-communicating pores.

In the vitrified grinding stone piece 26 (the grinding material layer 30) of the embodiment, the lubricant 42 encapsulated in the micro-capsules 38 has a characteristic of softening or degrading the work to be ground H and, for example, a stock solution of a grinding liquid is used as the lubricant 42. When the stock solution of the grinding liquid is used as the lubricant encapsulated in the micro-capsules 38 as above, high lubricating performance can be obtained and, therefore, grinding burns can advantageously be prevented.

In the vitrified grinding stone piece 26 (the grinding material layer 30) of the embodiment, the outer skin 44 of each of the micro-capsules 38 is configured by any one of gelatin, a melamine resin, a phenolic resin, and a urea resin. Because the outer skin of each of the micro-capsules is configured by such an organic material, the micro-capsules 38 can easily be broken on the grinding surface 20 and an advantage of giving no influence on the grinding performance can be obtained.

The embodiment of the present invention has been described as above in detail with reference to the accompanying drawings. However, the present invention is not limited to the embodiment and can also be reduced to practice in other aspects.

For example, in the embodiment, the outer skin 44 of the micro-capsule 38 may be configured by an inorganic material such as a vitreous material.

In the embodiment, the adhesive to fix the micro-capsules 38 on the inner surface of the air-communicating pores 36 does not always need to be a thermo-setting resin and may be a thermo-plastic resin, a CMC, etc.

In the embodiment, through-holes may be formed in and penetrating the base layer 28 and the grinding material layer 30 that are radially disposed centering the rotation shaft center W of the vitrified super-abrasive-grain grinding wheel 10.

In the embodiment, the base metal piece 18 is made of a metal such as, for example, carbon steel or an aluminum alloy and this configuration has a strength to tolerate even high-speed rotations and, therefore, is preferable. However, the base metal piece 18 is not limited to the above and may also be made of, for example, a synthesized resin, a fiber-reinforced resin, or a vitrified grinding stone. Instead of the base metal piece 18, a disc-shaped base configured by a sintered metal or a sintered piece of an inorganic material may be used.

The above embodiment is strictly just one embodiment and, though not exemplifying one by one, the present invention can be reduced to practice in variously changed or modified modes based on the knowledge of those skilled in the art without departing from the spirit thereof.

NOMENCLATURE OF ELEMENTS

10: Vitrified super-abrasive-grain grinding wheel
20: Grinding surface
26: Vitrified grinding stone pieces (Vitrified grinding stone)
30: Grinding material layer
34: Super abrasive grains
36: Air-communicating pores
38: Micro-capsules
42: Lubricant
44: Outer skin

The invention claimed is:

1. A vitrified grinding stone comprising:
abrasive grains;
an inorganic binder that binds the abrasive grains; and
air-communicating pores that are formed between the abrasive grains and the inorganic binder; and
micro-capsules that each encapsulate a lubricant and each have a diameter that is smaller than that of the air-communicating that are fixed on an inner wall surface of each of the air-communicating pores by a resin adhesive, and being exposed to the air-communicating pore.

2. The vitrified grinding stone of claim 1, wherein
the micro-capsules have an average capsule diameter of one to 200 μmϕ.

3. The vitrified grinding stone of claim 1, wherein
the lubricant encapsulated in each micro-capsule is configured by a grinding liquid.

4. The vitrified grinding stone of claim 2, wherein
the lubricant encapsulated in each micro-capsule is configured by a grinding liquid.

5. The vitrified grinding stone of claim 1, wherein
an outer skin of each micro-capsule is made of any one of gelatin, a melamine resin, a phenolic resin, and a urea resin.

6. The vitrified grinding stone of claim 2, wherein
an outer skin of each micro-capsule is made of any one of gelatin, a melamine resin, a phenolic resin, and a urea resin.

7. The vitrified grinding stone of claim 3, wherein
an outer skin of each micro-capsule is made of any one of gelatin, a melamine resin, a phenolic resin, and a urea resin.

8. The vitrified grinding stone of claim 4, wherein
an outer skin of each micro-capsule is made of any one of gelatin, a melamine resin, a phenolic resin, and a urea resin.

9. The vitrified grinding stone of claim 1, wherein
the abrasive grains are diamond abrasive grains or CBN abrasive grains that have an average grain diameter of five to 250 μmϕ, and
the air-communicating pores have an average inner diameter of five to 500 μmϕ.

10. The vitrified grinding stone of claim 2, wherein
the abrasive grains are diamond abrasive grains or CBN abrasive grains that have an average grain diameter of five to 250 μmϕ), and
the air-communicating pores have an average inner diameter of five to 500 μmϕ.

11. The vitrified grinding stone of claim 3, wherein
the abrasive grains are diamond abrasive grains or CBN abrasive grains that have an average grain diameter of five to 250 μmϕ, and
the air-communicating pores have an average inner diameter of five to 500 μmϕ.

12. The vitrified grinding stone of claim 4, wherein
the abrasive grains are diamond abrasive grains or CBN abrasive grains that have an average grain diameter of five to 250 μmϕ, and
the air-communicating pores have an average inner diameter of five to 500 μmϕ.

13. The vitrified grinding stone of claim 5, wherein
the abrasive grains are diamond abrasive grains or CBN abrasive grains that have an average grain diameter of five to 250 μmϕ, and
the air-communicating pores have an average inner diameter of five to 500 μmϕ.

14. The vitrified grinding stone of claim 6, wherein
the abrasive grains are diamond abrasive grains or CBN abrasive grains that have an average grain diameter of five to 250 μmϕ, and
the air-communicating pores have an average inner diameter of five to 500 μmϕ.

15. The vitrified grinding stone of claim 7, wherein
the abrasive grains are diamond abrasive grains or CBN abrasive grains that have an average grain diameter of five to 250 μmϕ, and
the air-communicating pores have an average inner diameter of five to 500 μmϕ.

16. The vitrified grinding stone of claim 8, wherein
the abrasive grains are diamond abrasive grains or CBN abrasive grains that have an average grain diameter of five to 250 μmϕ, and
the air-communicating pores have an average inner diameter of five to 500 μmϕ.

17. The vitrified grinding stone of claim 9, wherein the vitrified grinding stone is each one of a plurality of grinding stone pieces that are adhered on an outer circumferential surface of a core of a super-abrasive-grain grinding wheel.

18. The vitrified grinding stone of claim 10, wherein the vitrified grinding stone is each one of a plurality of grinding stone pieces that are adhered on an outer circumferential surface of a core of a super-abrasive-grain grinding wheel.

19. The vitrified grinding stone of claim 11, wherein the vitrified grinding stone is each one of a plurality of grinding stone pieces that are adhered on an outer circumferential surface of a core of a super-abrasive-grain grinding wheel.

20. The vitrified grinding stone of claim 12, wherein the vitrified grinding stone is each one of a plurality of grinding stone pieces that are adhered on an outer circumferential surface of a core of a super-abrasive-grain grinding wheel.

21. A manufacturing method of a vitrified grinding stone comprising:

a raw material mixing step of mixing abrasive grains, a viscous binder, and an inorganic binder that binds the abrasive grains;

a molding step of molding the row materials mixed by the raw material mixing step;

a burning step of burning a molded piece molded by the raw material mixing step so as to manufacture a vitrified grinding stone piece formed therein a porous vitrified grinding structure that has the abrasive grains bound by the inorganic binder and that has air-communicating pores;

a grinding stone impregnating step of impregnating the vitrified grinding stone piece in a processing solution included therein micro-capsules that each encapsulate a lubricant and each have a diameter smaller than that of the air-communicating pores, a resin adhesive, and dilution water; and a drying step of the vitrified grinding stone piece impregnated by the grinding stone impregnating step.

* * * * *